US010978265B2

(12) United States Patent
Lell

(10) Patent No.: US 10,978,265 B2
(45) Date of Patent: Apr. 13, 2021

(54) ELECTRICAL INTERRUPTION SWITCHING ELEMENT WITH A TUBULAR OR ROD-SHAPED COMPRESSION AREA WITH A VARYING CROSS-SECTIONAL DIAMETER

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 0 days.

(21) Appl. No.: 16/794,627

(22) Filed: Feb. 19, 2020

(65) Prior Publication Data

US 2020/0273648 A1 Aug. 27, 2020

(30) Foreign Application Priority Data

Feb. 21, 2019 (DE) ..... 102019104453.7

(51) Int. Cl.
*H01H 33/22* (2006.01)
*H01H 39/00* (2006.01)
*H01H 85/00* (2006.01)

(52) U.S. Cl.
CPC ..... *H01H 39/006* (2013.01); *H01H 33/22* (2013.01); *H01H 85/0043* (2013.01)

(58) Field of Classification Search
CPC .... H01H 39/006; H01H 39/002; H01H 39/00; H01H 2039/008; H01H 33/22;
(Continued)

(56) References Cited

U.S. PATENT DOCUMENTS 3,848,100 A * 11/1974 Kozorezov ..... H01H 39/006 200/61.08
4,342,978 A * 8/1982 Meister ..... H01H 39/00 200/82 B
(Continued)

FOREIGN PATENT DOCUMENTS

DE 2904207 A1 7/1980
DE 19819662 * 11/1998 ..... H01H 39/00
(Continued)

OTHER PUBLICATIONS

Translation DE19819662 (Original document published Nov. 12, 1998) (Year: 1998).*

*Primary Examiner* — William A Bolton
(74) *Attorney, Agent, or Firm* — Perry + Currier, Inc.

(57) ABSTRACT

An example electrical interruption switch includes a casing, surrounding a contact unit defining a current path therethrough. The contact unit has a first and second connection contact, a separation region and an upsetting region. A current supplied to the contact unit via the first connection contact, can be discharged via the second connection contact, or vice versa. The contact unit includes, or is connected to, a sabot configured to move from a starting to an end position via pressure; in the end position, the separation region is separated causing an insulation spacing between the first and second connection contacts. The upsetting region, upset during movement of the sabot from the starting to end positions, is formed as a tubular or rod-shaped element having an axis; the tubular or rod-shaped element has one or more tapers in its cross-sectional diameter; and the cross-sectional diameter is defined perpendicular to the axis.

7 Claims, 8 Drawing Sheets

(58) Field of Classification Search
CPC .... H01H 9/02; H01H 9/0066; H01H 85/0043; H01H 85/0241; H01H 2085/025
USPC ..... 200/61, 61.08; 218/158, 155, 95; 337/157, 30
See application file for complete search history.

(56) References Cited

U.S. PATENT DOCUMENTS

| | | | | |
|---|---|---|---|---|
| 4,345,127 | A * | 8/1982 | Niemeyer | H01H 39/006 200/61.08 |
| 4,490,707 | A * | 12/1984 | O'Leary | H01H 39/006 200/61.08 |
| 9,324,533 | B2 * | 4/2016 | Horne | H01H 85/44 |
| 9,911,560 | B2 * | 3/2018 | Lell | H01H 39/006 |
| 2013/0056344 | A1 * | 3/2013 | Borg | H01H 39/00 200/81 R |

FOREIGN PATENT DOCUMENTS

| | | | |
|---|---|---|---|
| DE | 202017106261 | U1 | 11/2017 |
| DE | 102017123021 | A1 | 12/2017 |
| WO | WO-03067621 | A1 | 8/2003 |

* cited by examiner

ELECTRICAL INTERRUPTION SWITCHING ELEMENT WITH A TUBULAR OR ROD-SHAPED COMPRESSION AREA WITH A VARYING CROSS-SECTIONAL DIAMETER

The invention relates to an electrical interruption switch, in particular for interrupting high currents at high voltages.

Such interruption switches are used for example in power plant and motor vehicle technology, and also in general mechanical and electrical engineering in electric switchboards of machines and plants, as well as within the framework of electromobility in electric and hybrid vehicles, but also in electrically operated helicopters and aircraft, for the defined and fast disconnection of high-current electrical circuits in case of an emergency. It is required of such switches that no hot gas, particles, ejected fragments or plasma leak from them. Furthermore, such switches are to ensure insulation resistance after the disconnection.

Further areas of application are the electrical disconnection of an assembly from the on-board electrical system in the event of a short circuit in the assembly concerned, for example in an independent electric heating system or in an electric brake, as well as the emergency shutoff of a lithium battery, such as are used today in electric and hybrid vehicles, as well as in aircraft. These batteries, with a small overall installed size, have a high terminal voltage of up to 1200 V with extremely low internal resistance. Both of these can potentially result in a short-circuit current of up to 5000 A, in some cases and briefly even up to 30 kA, without the source voltage dropping significantly, which even after a few seconds can lead to the battery igniting or exploding. The interruption switch presented here is also highly suitable for the emergency shutoff of individual solar cell modules or entire solar cell arrays should it be necessary, because it can be designed triggerable or remote-controllable.

All use cases mentioned here as a rule involve shutting off direct current, which, unlike alternating current, has no zero crossing. Normally, there is only the operating voltage in an interruption switch. At the moment of disconnection of a direct current circuit in an interruption switch, however, due to the collapse of the magnetic field of the outer electric circuit, the voltage increases strongly such that as a rule an electric arc forms between the separated ends of a separation element of an interruption switch. As a rule, a relatively high voltage is needed to generate an electric arc. However, to maintain it, much lower voltages are already sufficient, which is the case as a rule with usual operating voltages of approximately 450 V.

In order that the electric arc is also extinguished after the voltage peak has fallen to the operating voltage, switches with a contact tube conducting the current with a separation region in the form of a hollow cylinder are already used, wherein the hollow cylinder is completely torn open, melted open or broken open to disconnect the electric circuit along its cross-sectional surface area, and the two ends of the hollow cylinder are mechanically moved away from each other. To tear open or break open the hollow cylinder, an activatable drive is often used here, which is located in the cavity of the hollow cylinder. Furthermore, such interruption switches usually contain a sabot, which serves to move the separated ends of the separation region away from each other through a movement. The sabot must upset an upsetting region of the contact tube. The upsetting region is often likewise designed tubular or hollow cylindrical and must be able to fold well during the upsetting. However, it has been established that in the case of rapid movement of the sabot and upsetting of the upsetting region the latter often splinters and the casing can be improperly contacted electrically; the insulation of the already separated connecting element can be bridged here.

Starting from this state of the art, the object of the invention is to provide an interruption switch, in particular for interrupting high direct currents at high voltages, in which the material of the upsetting region is prevented from splintering during the transition from the conducting position into the separating position, in order that no splinters can short-circuit the contact between the assembly and the casing already separated and thereafter to be kept electrically insulated from the casing.

The invention achieves this object with the features provided herein.

The present invention relates to an electrical interruption switch which is suitable in particular for interrupting high currents at high voltages. It has a casing, which surrounds a contact unit defining the current path through the interruption switch. The contact unit has a first and second connection contact, a separation region and an upsetting region. The contact unit is formed such that a current can be supplied to it via the first connection contact and can be discharged therefrom via the second connection contact, or vice versa. The contact unit has a sabot or is connected to a sabot. The sabot is formed such that it can be moved from a starting position into an end position by exposure to pressure, wherein in the end position of the sabot the separation region is separated and an insulation spacing between the first and the second connection contact is achieved. The upsetting region is formed such that it is upset during the movement of the sabot from the starting position into the end position.

The interruption switch according to the invention is characterized in that the upsetting region is formed as a tubular or rod-shaped element, the axial direction of extent of which runs along an axis X, wherein along the axis X the tubular or rod-shaped element has one or more tapers in its cross-sectional surface area, wherein the cross-sectional surface area is perpendicular to the axis X.

Through the one or more tapers, unlike in the case of a cross-sectional surface area that is unchanging along the axis X, splinters of the upsetting region can be largely prevented from tearing away during the transition from the conducting position into the separating position, with the result that the already separated contact of the interruption switch cannot be contacted electrically towards the casing. Hereby, no larger parts are torn out of the upsetting region, but there is a folding of the upsetting region without harmful splinter formation.

In a design of the present invention, it is preferred for the tubular or rod-shaped element to merge at its two opposite end regions in each case into flanges which extend in the direction of the casing and perpendicular to the axis X. These flanges serve in order that a force can be exerted starting from the sabot in the direction of the axis X on the upsetting region, i.e. the upsetting region can be upset.

The cross-sectional surface area of the rod-shaped or tubular element can have any desired shape, for example circular, elliptical, circular as desired without or with one or more corners, triangular, quadrangular, pentagonal, hexagonal or polygonal, wherein a circular cross-sectional surface area is preferred. If it is a tubular element, then an annular cross-sectional surface area is discussed rather than a circular cross-sectional surface area.

By a taper of the cross-sectional surface area is meant herein that the cross-sectional surface area is smaller in one region of the upsetting region than at the bordering regions (in the direction of the axis X). In the case of the taper the upsetting region has a region of a minimum cross-sectional surface area which preferably increases in the direction towards the two end regions of the upsetting region.

The increase in the cross-sectional surface area can be continuous or discontinuous, i.e. for example stepped, in the axial extent of the rod-shaped or tubular element, wherein a continuous increase is preferred. The continuous increase can be effected linearly or progressively. It is preferred according to the invention that the cross-sectional surface area increases in each case conically in the direction of the end regions of the rod-shaped or tubular element. Furthermore, it is preferred for the rod-shaped or tubular element to be formed such that it has a cross-sectional surface area of identical shape (with varying size of the surface area) in every plane perpendicular to the axis X. Furthermore, the increase in the cross-sectional surface area can run differently or identically, i.e. mirror-symmetrically, in both directions towards the end regions of the rod-shaped or tubular element, wherein the mirror plane is arranged in the region of the minimum cross-sectional surface area perpendicular to the axis X. It is also preferred for the cross-section transitions to run radially towards the respective end regions of the rod-shaped or tubular element, i.e. to be provided with particular radii, in order to prevent notch stresses that are too high here, which could partially break or break open the rod-shaped or tubular element in an undesired manner at these points, in particular in the case of mechanical stresses or vibrations of the assembly or of the connecting element.

In a design of the present invention, it is preferred for the upsetting region to have several tapers, preferably with the result that the region of the minimum cross-sectional surface area alternates periodically with regions of maximum cross-sectional surface area. In this case, on the surface the upsetting region can be formed zigzagged, stepped or in the shape of a concertina. The latter is preferred if the upsetting region is formed as a tubular element.

The region of the minimum cross-sectional surface area of the rod-shaped or tubular element can be formed as a region with unchanging cross-sectional surface area. It is preferred for the cross-section transitions from the region with minimum cross-sectional surface area towards the regions in which the cross-sectional surface area increases to run radially, i.e. to be provided with particular radii. In an embodiment, such a region with unchanging cross-sectional surface area can also be dispensed with, i.e. in the region of the minimum cross-sectional surface area the regions in which the cross-sectional surface area increases converge, likewise preferably with a radially running cross-section transition.

In a design, the interruption switch according to the invention has at least one chamber, which is at least partially delimited by the separation region. The at least one chamber is preferably filled with an extinguishing agent, with the result that the separation region is in contact with the extinguishing agent. The at least one chamber is preferably located inside a cavity of the separation region, which is preferably formed as a tubular element, i.e. the at least one chamber is surrounded by the separation region. Furthermore, the interruption switch according to the invention can have a further chamber, which borders the outer region of the tubular element of the separation region. In other words, the tubular element delimits the at least one chamber from the further chamber. The further chamber is preferably delimited in its outer circumference by the casing of the interruption switch. The further chamber is preferably likewise filled with an extinguishing agent.

However, filling the cavity of the tubular element of the separation region can also be dispensed with, in this case only the further chamber outside the tubular connecting element is filled with an extinguishing agent. In the case of very small currents to be disconnected in conjunction with very small electric circuit inductances, however, the extinguishing agent can also be dispensed with entirely, here the enclosed air is then sufficient for the disconnection operation.

The extinguishing agent can be a solid, powdery or liquid medium. The extinguishing agent is preferably a vaporizable or gasifiable medium (e.g. boric acid; this powder passes directly from the powdery phase into gas when affected by an electric arc, wherein it absorbs energy and thus depletes the electric arc). The extinguishing agent is preferably a liquid medium, which passes entirely or partially into a gaseous state when the boiling or vaporization temperature is reached. At the same time, it is preferred for the extinguishing agent to also have good electrically insulating properties, in order that the electric arc can be extinguished after the two separated parts of the separation region have been moved away from each other sufficiently and there is thereafter a sufficient insulation from a current flow, which is then undesired here, between the separated contacts. The extinguishing agent is preferably an oil with or without thickening agent, for example silicone oil, or a silane or polysiloxane, for example hexasilane or pentasilane with as little as possible, or even better without, carbon atom content.

In the interruption switch according to the invention the sabot has the object of separating the two separated parts of the separation region from each other by carrying out, through exposure to pressure, a mechanical movement which moves one part of the separated separation region away from the other part of the separated separation region. In this way, a safe distance between the two separated parts of the separation region is produced.

The tripping of the interruption switch according to the invention, i.e. of the operation of transition from the conducting position into the separating position, can be effected passively or actively.

If the tripping of the interruption switch according to the invention is to be effected actively, it is preferred for the interruption switch to comprise an activatable material. The activatable material is preferably arranged such that, when the pyrotechnic material is ignited, the separation region is exposed to a gas pressure or shock wave generated by the activatable material, with the result that the separation region is torn open, caved in or separated, the sabot is moved and the upsetting region is upset. The sabot is preferably designed such that, when the activatable material is ignited, it is exposed to a gas pressure or shock wave generated thereby such that the sabot in the casing is moved in a movement direction from the starting position into the end position and in the process the separation region is torn open, caved in or separated.

The activatable material can be a pyrotechnic material, which acts in a detonative or deflagrating manner. The pyrotechnic material is present in the interruption switch according to the invention, preferably in a so-called mini detonator, or an ignition tablet or squib, but can also be introduced in another form.

If the tripping of the interruption switch according to the invention is to be effected passively, i.e. without an activatable material to sever the separation region for the first time, it is preferred for the separation region, the sabot and the extinguishing agent to be formed such that the separation region can be separated into at least two parts through the supplied current when a threshold amperage is exceeded by heating to or beyond the melting point of the material of the connecting element, wherein an electric arc forming between the two parts of the separation region vaporizes the extinguishing agent, with the result that a gas pressure to which the sabot is exposed forms, wherein the sabot is moved and the upsetting region is upset.

Furthermore, the separation region can also have one or more predetermined breaking points, which can be present in the form of a narrowing, notch, groove or hole. The predetermined breaking point is preferably present in the form of a hole through the wall of the tubular element of the separation region. In this way, the hole connects the at least one chamber to the further chamber. In this way, during the production of the interruption switch according to the invention it is easier to pour an extinguishing agent into the at least one chamber inside the tubular element.

The design according to the invention of the upsetting region is of advantage or great importance in particular in the case of the use of materials for the upsetting region which are not as ductile as the electrolytic copper usually used here. For example, for the processing of aluminum as raw material for the connecting element a hard aluminum must be used, which would immediately break up into many small splinters during the folding operation, even after soft-annealing of the connecting element after the production thereof.

According to a design of the invention it is preferred for the upsetting region to be formed as a tubular element. The cavity inside the tubular element is called the yet further chamber herein. Here, the yet further chamber of the upsetting region can also be completely filled with an extinguishing agent. It is preferred for a connection in the form of a channel to be present between the yet further chamber and the at least one chamber. Through the movement of the sabot and/or the upsetting operation of the upsetting region, the volume of the yet further chamber is reduced such that the extinguishing agent is injected through the channel between the at least two parts of the separation region. The extinguishing agent can thereby be pushed out of the yet further chamber via the channel into the at least one chamber during the upsetting operation and thus more effectively suppresses or cools the electric arc possibly still present at the separation region. At the same time the extinguishing agent, which may have already partially decomposed in the at least one chamber, is diluted by the extinguishing agent newly flowing in, and thus the insulating properties of the "stressed" extinguishing agent are likewise improved. In this design of the invention it may also be preferred for only the one chamber and the yet further chamber as well as the connecting channel to be filled with an extinguishing agent. It may be preferred here for the further chamber to contain no extinguishing agent.

The features of the interruption switch according to the invention set out in the above-named embodiments can—unless they are mutually exclusive—be combined as desired according to the invention.

The invention is explained in more detail below with reference to the embodiments represented in the drawings. All individual features described in the figures can—provided this is technically possible—also be used independently of each other in an interruption switch according to the invention.

Figure 1A:
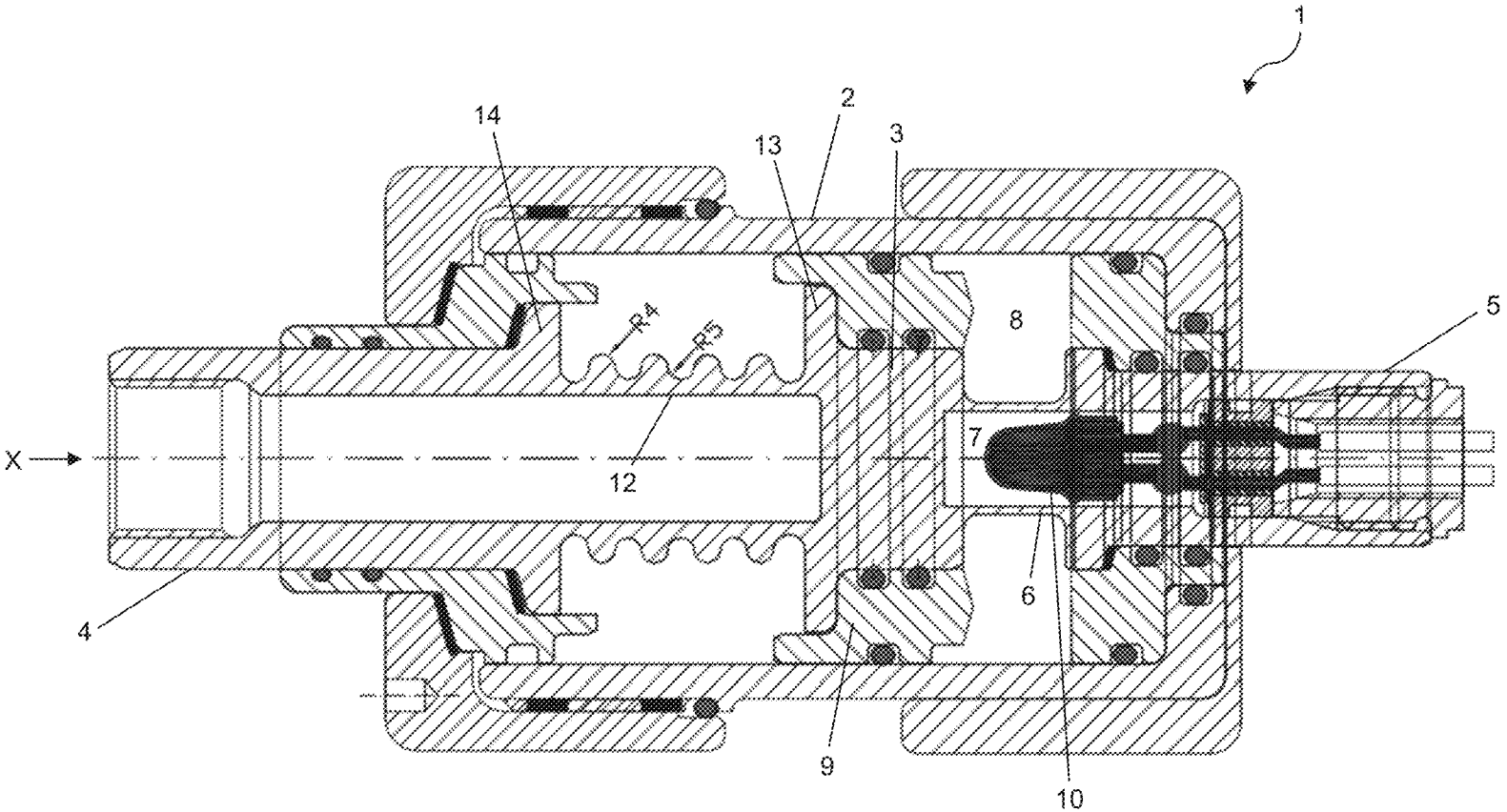
FIGS. 1A and 1B show schematic views of an interruption switch according to the invention respectively before and after the upsetting region is upset (conducting position), which is present in the form of a rod-shaped element with several tapers in its cross-sectional diameter.
Figure 1B:
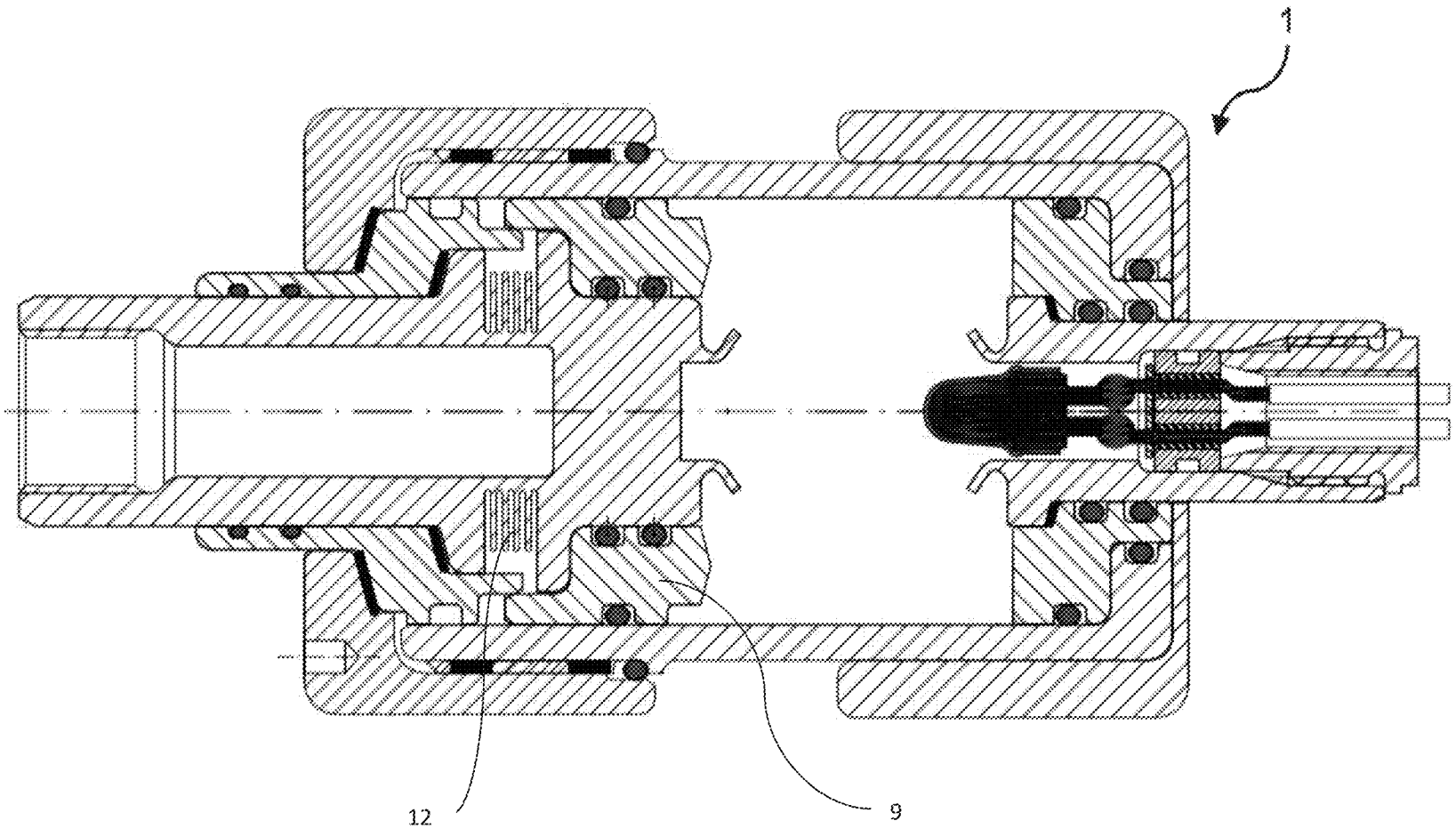

The embodiment represented in FIGS. 1A and 1B of an interruption switch 1 according to the invention comprises a casing 2, in which a contact unit 3 is arranged, which extends through the entire casing 2, and comprises the connection contacts 4 and 5, the separation region 6, the upsetting region 12 and the flanges 13 and 14. The casing 2 is formed such that it withstands a pressure, generated inside the casing 2, which is generated for example in the case of a pyrotechnic tripping of the interruption switch 1, without there being the danger of damage or even bursting. The casing 2 can consist in particular of a suitable material, preferably steel. In the embodiment example represented, the contact unit 3 is formed as a switch tube that can be depressed by the sabot 9 in the upsetting region 12, with the result that it is formed as a tube in the separation 6 and upsetting 12 regions. In the embodiment example represented, the contact unit 3 has a first connection contact 4. Adjoining the first connection contact 4 is a flange 14 extending radially outwards, which is braced on an annular insulator element, which consists of an insulating material, for example a plastic, such that the contact unit 3 cannot be moved out of the casing 2 in the axial direction. The contact unit 3 has an upsetting region 12 adjoining the flange in the axis of the contact unit 3. In the upsetting region 12, which has a predetermined axial extent, the wall thickness of the contact unit 3 is chosen and matched to the material such that, when the interruption switch 1 is tripped as a result of a plastic deformation of the contact unit 3 in the upsetting region 12, the upsetting region 12 is shortened in the axial direction by a predetermined distance.

Adjoining the upsetting region 12 in the axial direction of the contact unit 3 is a flange 13, on which a sabot 9 sits in the embodiment example represented. The sabot 9 is formed as an electrically insulating element, for example a suitable plastic, preferably made of ceramic. This surrounds the contact unit 3 such that an insulating region of the sabot 9 engages between the outer circumference of the flange 13 and the inner wall of the casing 2. If a pressure acts on the surface of the sabot 9, a force F is generated which compresses the upsetting region 12 of the contact unit 3 via the flange 13. This force F is chosen such that, during the tripping operation of the interruption switch 1, an upsetting of the upsetting region 12 occurs, wherein the sabot 9 is moved from its starting position (as seen in FIG. 1B, status before the interruption switch 1 is tripped=conducting position) into an end position (as seen in FIG. 1B, after the switching operation has been completed=separating position).

As can be seen from FIGS. 1A and 1B, the sabot 9 can be chosen such that its external diameter corresponds substantially to the internal diameter of the casing 2, with the result that an axial guidance of the flange 13 and thus also an axially guided upsetting movement during the switching operation is achieved.

After the pressing operation the lugs of the insulator element and of the sabot 9 located close to the casing 2 overlap completely, as seen in FIG. 1B, with the result that the upsetting region 12 pushed together in a meandering fashion after the tripping and the upsetting region 12 is completely surrounded by electrically insulating materials.

Adjoining the sabot 9 or the flange 13 of the contact unit 3 is a separation region 6. The second connection contact 5 then adjoins this side of the contact unit 3.

In the embodiment example represented the sabot 9 is pushed onto the contact unit 3 from the side of the connection contact 5 during the assembly of the interruption switch 1. For this purpose it is split (not drawn). If the second connection contact 5 is not split or if it is in one piece like the contact unit 3, as drawn, the sabot 9 must either be injection-molded or be designed in several parts, in order to be able to install it.

In the axial end of the contact unit 3 in the region of the second connection contact 5 an activatable material 10 can be provided, here often also housed in a mini detonator or a priming screw (drive). Electrical connection lines for the drive can be guided outwards through an opening in the interior of the contact unit 3. The drive is preferably provided in a chamber 7 inside the tubular element of the separation region 6. A further chamber 8 is located between the outer wall of a separation region 6 and the casing 2.

The separation region 6 is dimensioned such that it tears open at least partially, but preferably tears open completely, through the gas pressure generated or the shock wave generated by a drive, with the result that the pressure or the shock wave can also propagate out of the chamber 7 into the outer chamber 8 preferably designed as a surrounding annular space. In this way the chambers 7 and 8 are connected to each other to form one volume. The internal pressure required for upsetting the contact unit 3 can also be generated such that in the case of a particular threshold amperage the separation region 6 melts open and an electric arc forms in between, which vaporizes an extinguishing agent located in the chambers 7 and/or 8. To facilitate the tearing open, the wall of the contact unit 3 in the separation region 6 can also have one or more openings or holes and/or grooves (not shown in FIGS. 1A and 1B). It is to be ensured here that the material of the separation region 6 disconnects the operating current well, thus does not become too hot taking into account heat dissipation, in order that the material cannot be aged too quickly or too much.

When the interruption switch 1 is activated, a pressure or even a shock wave is thus generated on the side of the sabot 9 facing away from the upsetting region 12, whereby the sabot 9 is exposed to a corresponding axial force. This force is chosen through a suitable dimensioning of the activatable material 10 such that in the upsetting region 12 the contact unit 3 is plastically deformed or caved in, but not torn open, and the sabot 9 is then moved in the direction of the first connection contact 4. The activatable material 10 is dimensioned such that, after the separation region 6 has been broken open or caved in, the movement of the sabot 9 moves the two separation halves sufficiently far away from each other, in cooperation with the vaporization of an extinguishing agent then even into an end position.

Directly after the activatable material 10 has been activated, the separation region 6 is thus at least partially torn open or caved in, preferably completely torn open. If the tearing open or caving in has not already been effected before the start of the axial movement of the sabot 9 over the entire circumference of the separation region 6, a residual remainder of the separation region 6, which causes another electrical contact, is completely torn open by the axial movement of the sabot 9, intensified by the very rapid heating then occurring here of the residual cross section of the conductor, which is then only small here, due to the high electric current flowing here.

The interruption switch 1 according to FIGS. 1A and 1B is in principle constructed exactly like the interruption switch of DE 10 2017 123 021 A1 shown in FIG. 1, with the difference according to the invention that the upsetting region 12 does not represent a tubular element with a continuously identical wall thickness, but the tubular element has several tapers in its cross-sectional diameter in a region between the flange-side end regions. The tapers repeat periodically in FIGS. 1A and 1B. In addition, the tapers are rounded, namely preferably such that the surface of the tubular element forms a sinusoidal course in cross section along the axis X.

FIGS. 2 to 8 show in each case a partial region of a contact unit 3, in which the upsetting region 12 and the flanges 13 and 14 adjoining it are present. The upsetting region 12 is formed as a tubular element in FIGS. 2, 3 and 5 to 8 and as a rod-shaped element in FIG. 4. The length L is the extent of the upsetting region 12 in the direction of the axis X. The upsetting region 12 has a region with minimum cross-sectional surface area (surface area which is delimited by the outer circumference of the tubular element), which increases in each case in the direction of the flange-side end regions, i.e. towards the flanges 13 and 14. The radii R1 and R2 represent the radii of the cross-section transitions between the upsetting region 12 and the adjoining flanges 13 and 14. The radii R3 to R5 represent the radii of the cross-section transitions in the region of the minimum cross-sectional surface area(s) to the regions of the increasing cross-sectional surface area(s). The force F acts on the upsetting region 12 during movement of the sabot 9. The angles w1-w4 indicate the gradient of the increase of the cross-sectional surface area relative to the axis X.

Figure 2:
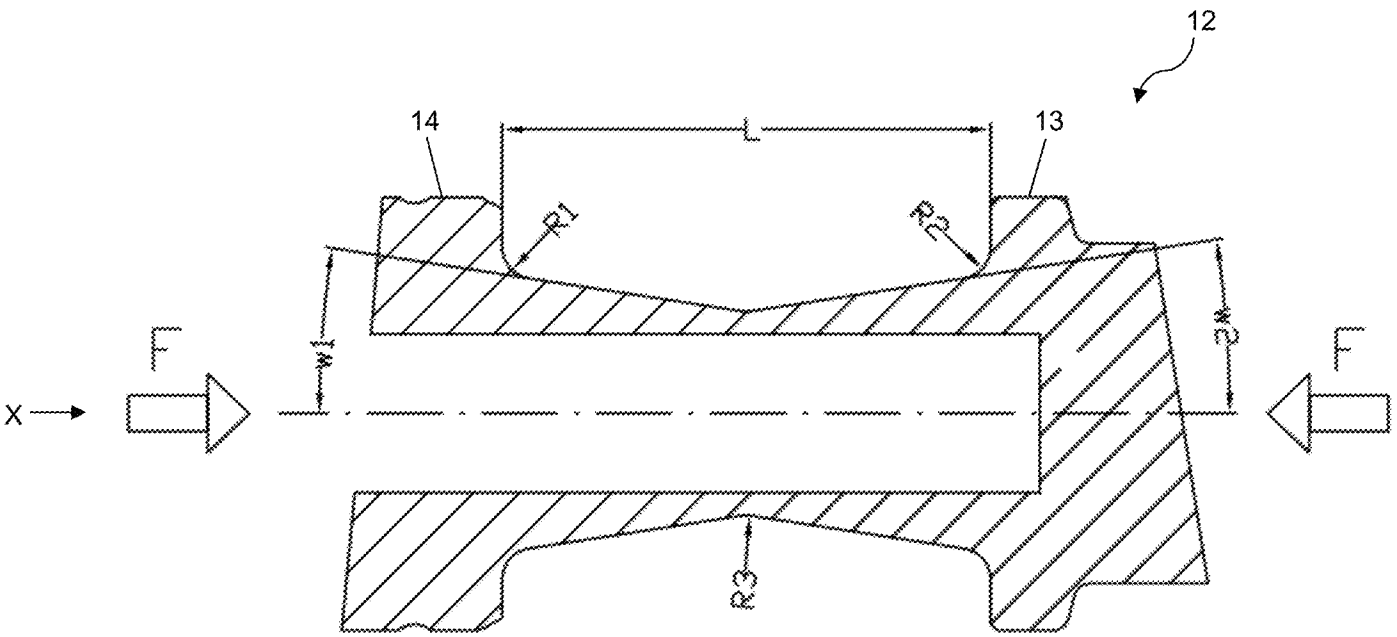
FIGS. 2 to 8 show sections of a contact unit of an interruption switch according to the invention in the upsetting region with different shapes of the tapers in the cross-sectional diameter.

FIG. 2 shows an upsetting region 12 with only a minimum cross-sectional surface area. Here the increase in the cross-sectional surface area is also effected uniformly in the direction of both flange-side ends of the upsetting region 12. The angles w1 and w2 here are therefore equally large, in order thus to achieve as uniform as possible an upsetting, which would not be achieved in the case of angles not equally large.

Figure 3:
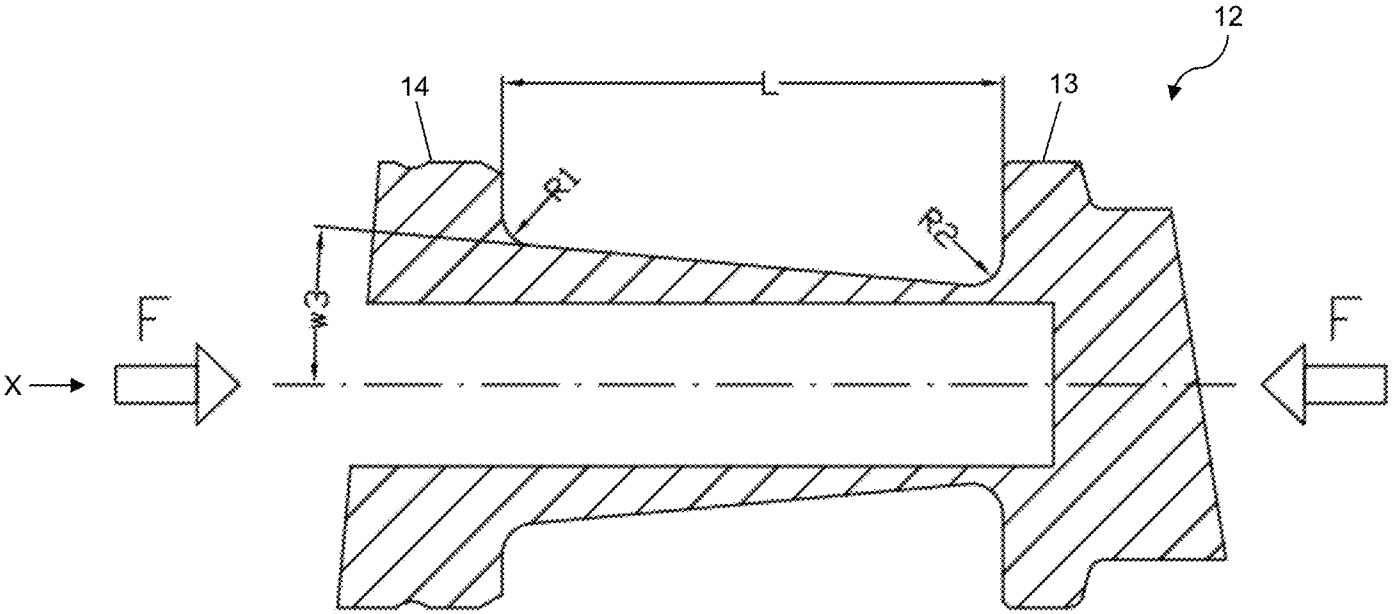

FIG. 3 shows an upsetting region 12, which runs conically from one flange-side end to the other flange-side end. The region of the minimum cross-sectional surface area is located adjacent to the flange 13.

Figure 4:
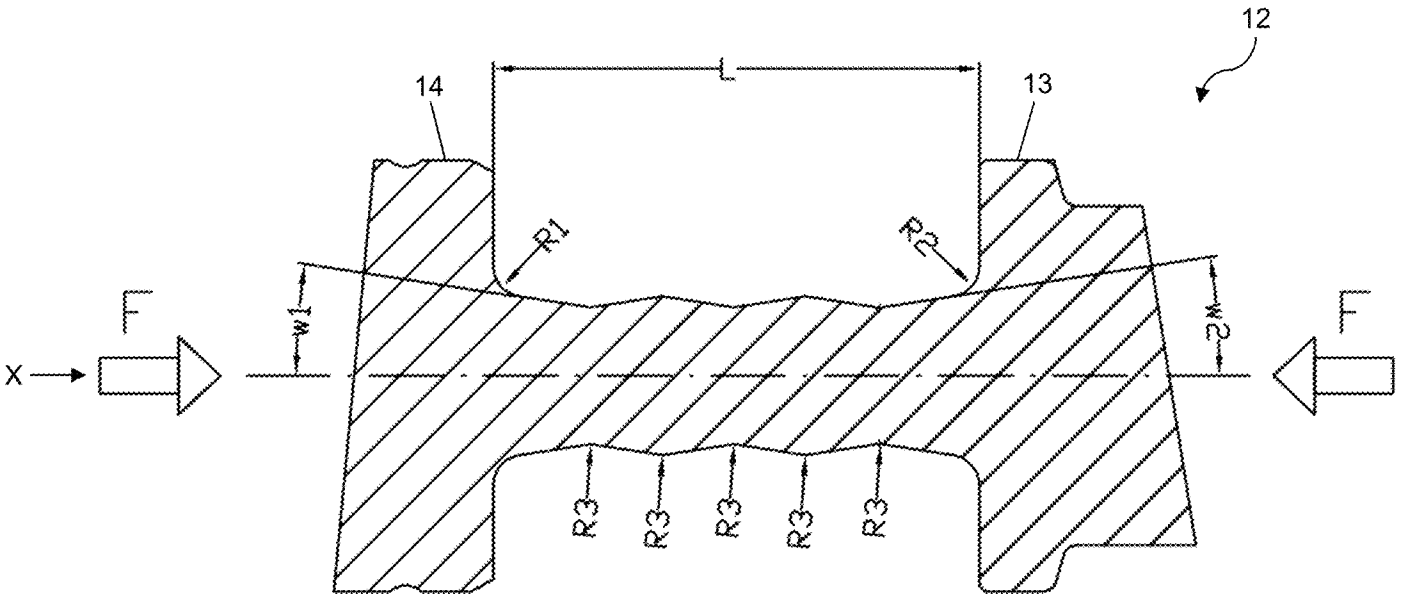
Figure 5:
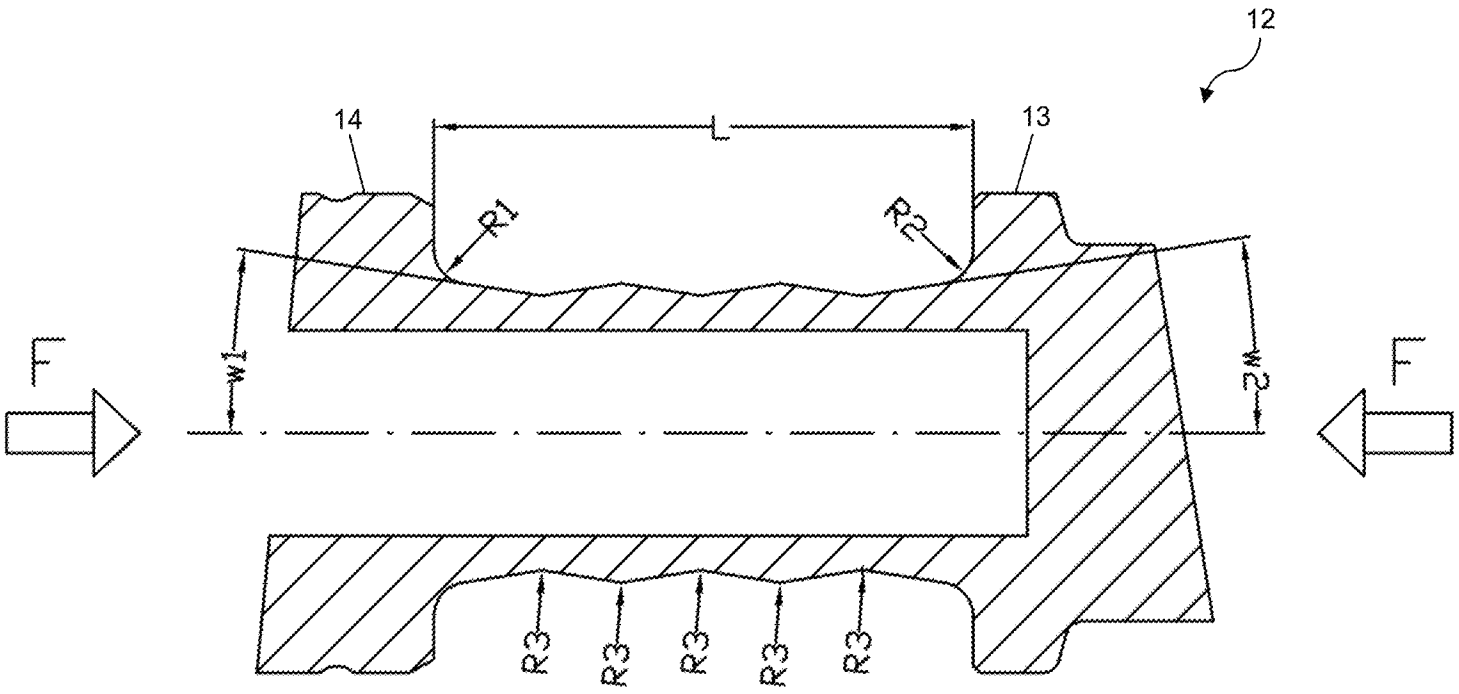

FIGS. 4 and 5 show embodiments with several regions with minimum cross-sectional surface area. In between there are regions with maximum cross-sectional surface area. The increase and decrease in the cross-sectional surface areas between these regions run in a zigzag manner here.

The shown changes in the cross-sectional surface areas are chosen in order to allow the length L of the upsetting region to become longer or to be able to use it before the upsetting region would not upset, but would buckle, due to the pressure load, which would be entirely undesired here:

Corresponding to Euler buckling case 4 (both ends of the buckling rod clamped tightly and pressure load on the rod), the critical buckling load here is calculated as $F_{crit}=4*pi^2/L^2*E*I$ with the clamped length L, the modulus of elasticity of the rod material E and the axial moment of inertia I of the rod cross section. If the critical buckling load is reached, the rod here would buckle in the middle, in the case of hollow bodies would bulge—which is entirely undesired here and is to be safely prevented, because a contact of the disconnecting switch against the casing would thus short-circuit and bypass an insulator.

On the other hand, as long as possible an upsetting length L is desired in order to be able to convert as much as possible of the energy introduced into the assembly/disconnecting switch plastically.

Through the shown changes in the cross-sectional surface areas in the upsetting region, effectively the available upsetting length L is divided into several smaller upsetting stretches, the upsetting regions of which are then predefined by the cross-sectional changes.

The above-described operations apply analogously to all upsetting bodies, regardless of whether their cross section is completely filled (here only kinking occurs) or whether a tube-like upsetting element is present (here kinking and bulging can occur).

Figure 6:
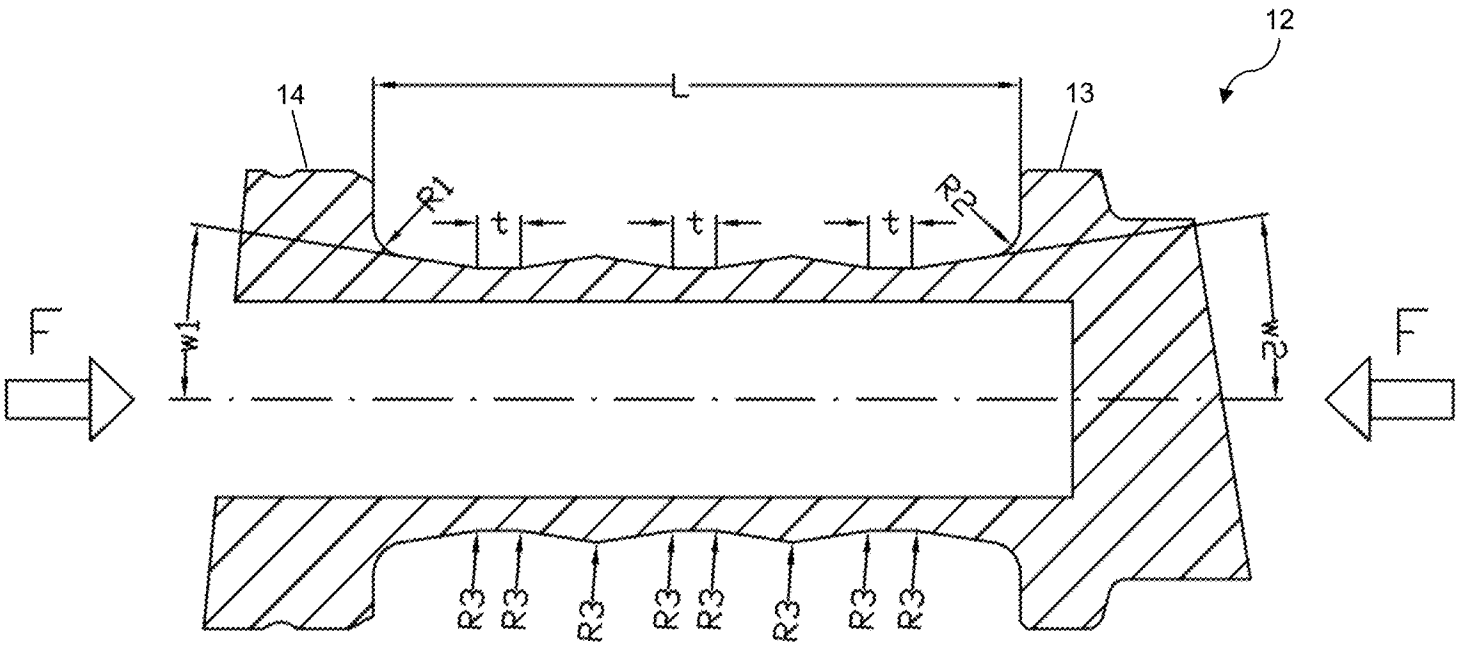

As shown in FIG. 6, the region of the minimum cross-sectional surface area can also be cylindrical in a length t and only then merge into the regions of the increase or decrease in the cross-sectional surface area.

Figure 7:
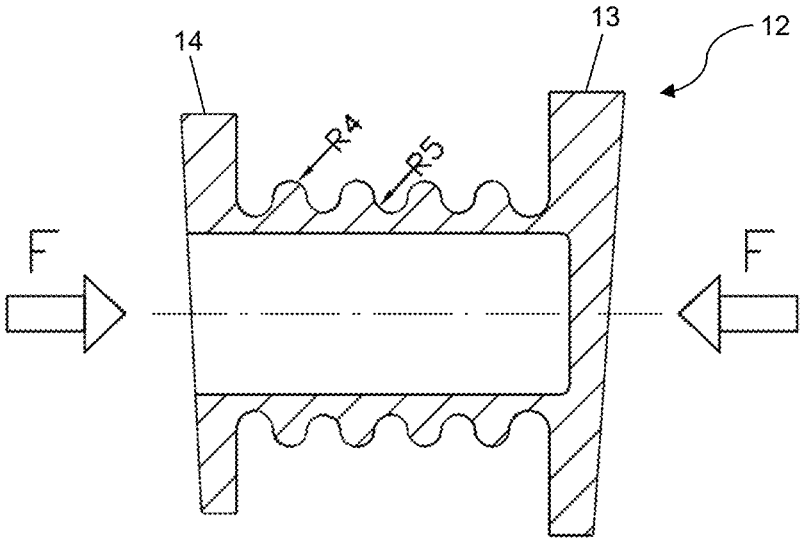
Figure 8:
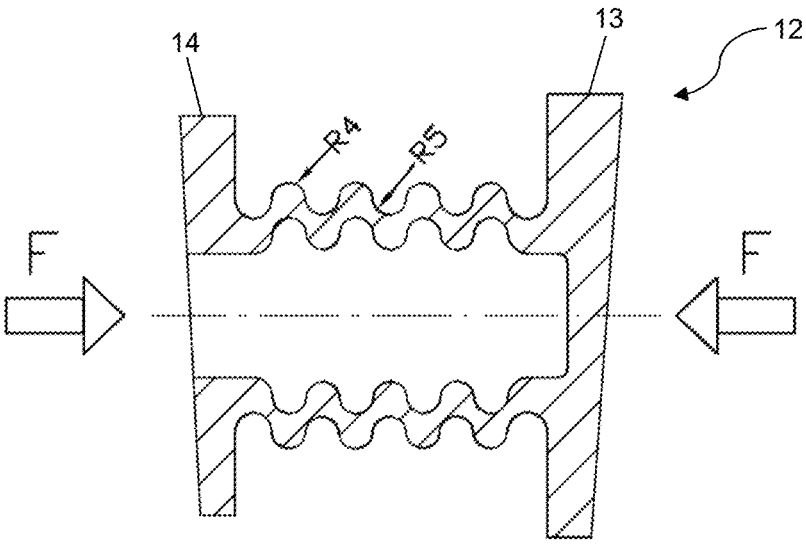

As shown in FIGS. 7 and 8, the surface of the upsetting region 12 can also run in the shape of a concertina. In FIG. 7 the outer surface of the upsetting region 12 runs in a wavy manner and the inner surface is flat. FIG. 8 shows an embodiment in which both inner and outer surfaces have a wavy course, in this case with sine curves running parallel.

LIST OF REFERENCE NUMBERS

1 interruption switch
2 casing
3 contact unit
4 first connection contact
5 second connection contact
6 separation region
7 chamber
8 further chamber
9 sabot
10 activatable material
12 upsetting region
13 flange on the upsetting region for exposure to pressure by sabot
14 flange on the upsetting region
L length of the extent of the upsetting region in the direction of the axis X
R1-R5 radii of the cross-section transitions
t length of the cylindrical regions with minimum wall thickness in the upsetting region
w1-w4 angles of the linear increase in the wall thickness
X axis X
z length of the cylindrical region with minimum wall thickness in the separation region
F force, due to exposure to pressure by sabot

The invention claimed is:

1. An electrical interruption switch for interrupting high currents at high voltages, the electrical interruption switch comprising:

a casing surrounding a contact unit defining a current path through the electrical interruption switch, the contact unit having a first connection contact, a second connection contact, a separation region and an upsetting region, the contact unit configured to receive a current supplied to the contact unit via the first connection contact; and discharge the current therefrom via the second connection contact, or vice versa, the contact unit including a sabot, or is connected to the sabot, the sabot configured to move from a starting position into an end position by exposure to pressure, wherein in the end position of the sabot, the separation region is separated and an insulation spacing between the first connection contact and the second connection contact is achieved, the upsetting region configured to upset during movement of the sabot from the starting position into the end position, the upsetting region formed as a tubular or rod-shaped element, an axial direction an extent of which runs along an axis X, wherein the tubular or rod-shaped element has one or more tapers in a cross-sectional surface area along the axis X, wherein the cross-sectional surface area is perpendicular to the axis X, and wherein a taper of the upsetting region has a region of a minimum cross-sectional surface area which increases in a direction towards two end regions of the upsetting region.

2. The electrical interruption switch according to claim 1, wherein the tubular or rod-shaped element merges, at two opposite end regions, into respective flanges which extend in a direction of the casing and perpendicular to the axis X.

3. The electrical interruption switch according to claim 1, wherein an increase in the cross-sectional surface area runs mirror-symmetrically in the direction of the end regions, wherein a mirror plane is arranged in the region of the minimum cross-sectional surface area perpendicular to the axis X.

4. The electrical interruption switch according to claim 1, wherein the upsetting region has several tapers, such that the region of the minimum cross-sectional surface area alternates periodically with regions of maximum cross-sectional surface area.

5. The electrical interruption switch according to claim 1, wherein at least one chamber in the electrical interruption switch, which is at least partially delimited by the separation region, is filled with an extinguishing agent, such that the separation region is in contact with the extinguishing agent.

6. The electrical interruption switch according to claim 5, wherein the separation region, the sabot and the extinguishing agent are formed such that the separation region is separable into at least two parts through a supplied current when a threshold amperage is exceeded, wherein an electric arc forming between the two parts of the separation region vaporizes the extinguishing agent, such that a gas pressure to which the sabot is exposed forms, wherein the sabot is moved and the upsetting region is upset.

7. The electrical interruption switch according to claim 1, wherein the interruption switch comprises an activatable material, arranged such that, when the activatable material is ignited, the separation region is exposed to a gas pressure or shock wave generated by the activatable material, such that the separation region is torn open, caved in or separated, the sabot is moved and the upsetting region is upset.

* * * * *